United States Patent [19]

Lewis

[11] 4,342,291

[45] Aug. 3, 1982

[54] EXPANDABLE PISTON MOTOR

[76] Inventor: William C. Lewis, 7560 Belair Dr., Richmond, British Columbia, Canada

[21] Appl. No.: 112,595

[22] Filed: Jan. 16, 1980

[51] Int. Cl.[3] ..... F02B 75/04

[52] U.S. Cl. ..... 123/78 B; 123/41.38; 123/193 P; 92/220

[58] Field of Search ..... 123/41.35, 41.36, 41.38, 123/47 R, 48 B, 78 B, 193 P; 92/80, 82, 216, 220, 255; 91/422

[56] References Cited

U.S. PATENT DOCUMENTS

| | | | |
|---|---|---|---|
| 2,142,175 | 1/1939 | Buttner | 123/41.38 |
| 2,144,449 | 1/1939 | Church | 123/41.38 |
| 3,136,306 | 6/1964 | Kamm | 123/41.38 |
| 3,200,798 | 8/1965 | Mansfield | 123/78 B |
| 3,450,111 | 6/1969 | Crowstedt | 123/48 B |
| 4,241,705 | 12/1980 | Karaba et al. | 123/78 B |

FOREIGN PATENT DOCUMENTS

| | | | |
|---|---|---|---|
| 1808762 | 12/1977 | Fed. Rep. of Germany | 123/78 B |

*Primary Examiner*—Craig R. Feinberg
*Assistant Examiner*—W. R. Wolfe
*Attorney, Agent, or Firm*—Townsend and Townsend

[57] ABSTRACT

An internal combustion engine comprises a piston having first and second coaxial parts movable axially relative to each other in the direction of reciprocation of the piston and having a chamber therebetween which varies in volume with the relative movement. A conduit for fluid connects the chamber to a lubricant opening on a crank pin of a crankshaft. An inlet rotary valve between the lubricant opening and the chamber permits a flow of pressurized lubricant from the opening to the chamber at a first rotational position of the crankshaft and seals the chamber from the opening at other rotational positions of the crankshaft.

13 Claims, 5 Drawing Figures

EXPANDABLE PISTON MOTOR

BACKGROUND OF THE INVENTION

This invention relates to an expandable piston motor utilizing rotary valves.

Expandable piston motors, also referred to as variable compression ratio (VCR) motors, are disclosed in such earlier U.S. Pat. Nos. as 2,910,826 and 3,200,798 to Mansfield, 3,161,112 to Wallace, 3,185,137 to Dreyer, 3,185,138 to Druzynski and 3,303,831 to Sherman. These patents disclose pistons which include an outer portion with an inner portion slidably received therein. The connecting rod is connected to the inner portion and there is a chamber between the inner and outer portions adjacent the crown of the piston. A passage in the connecting rod supplies oil from the lubrication system to the chamber. These motors usually rely upon the inertial tendency of the outer portion of the piston to move upwardly relative to the inner portion at the end of the exhaust stroke in order to move the lubricating oil into the chamber. U.S. Pat. No. 3,200,798 employs a pump mechanism for this purpose. To prevent a reverse flow of lubricant, nonreturn valves are usually fitted. In order to discharge oil from the chamber, a discharge valve is activated at a predetermined pressure in most such engines.

The lubricating oil filling the chamber raises the outer portion of the piston relative to the inner portion to increase the compression ratio and thereby improve the efficiency of the engine. This would occur if the engine is operating at part throttle when the pressure in the combustion chamber would normally be less than optimum. When the pressure is increased to the optimum amount, or the design limits of the engine, the oil is released from the chamber through the discharge valve.

The engines disclosed in the previous patents listed above do not provide any mechanism for precisely timing the intake and discharge of lubricating oil to and from the chamber. Moreover, they rely upon a plurality of valves in each piston to regulate the flow of oil.

SUMMARY OF THE INVENTION

According to the invention an internal combustion engine comprises a piston having first and second coaxial parts movable axially relative to each other in the direction of reciprocation of the piston and having a chamber therebetween which varies in volume with the relative movement. A conduit for fluid connects the chamber to a lubricant opening on a crank pin of a crankshaft. Inlet rotary valve means between the lubricant opening and the chamber permits a flow of pressurized lubricant from the opening to the chamber at a first rotational position of the crankshaft and seals the chamber from the opening at other rotational positions of the crankshaft an outlet passageway connected to the chamber is also provided, along with outlet rotary valve means in the outlet passageway for permitting a flow of lubricant outwardly from the chamber at a second rotational position of the crankshaft.

Preferably, the engine comprises a piston having first and second coaxial parts movable axially relative to each other in the direction of reciprocation of the piston and having a chamber therebetween which varies in volume with the relative movement. As well, a conduit for fluid connects the chamber to a lubricant opening on a crank pin of a crank shaft. Inlet rotary valve means between the lubricant opening and the chamber permits a flow of pressurized lubricant from the opening to the chamber at a first rotational position of the crank shaft and seals the chamber from the opening at other rotational positions of the crankshaft. A wrist pin nonrotatably mounted on the connecting rod and rotatably connected to the second coaxial part of the piston is also provided. An outlet passageway in the second part of the piston communicates with the chamber and has an opening adjacent the wrist pin. An outlet passageway in the wrist pin is provided which has an opening adjacent the second part. The openings of the outlet passageways are aligned at a second rotational position of the crankshaft.

Preferably, there is a check valve in the outlet passageways permitting a flow of lubricant from the chamber when the lubricant is above a preset pressure only.

Preferably, the second rotational position of the crankshaft is generally 20° before top dead center of the piston.

The engine may also usefully comprise a piston having first and second coaxial parts movable axially relative to each other in the direction of reciprocation of the piston and having a chamber therebetween which varies in volume with the relative movement. A conduit for fluid connects the chamber to a lubricant opening on a crank pin of a crankshaft, a portion of the conduit being disposed on the connecting rod. Inlet rotary valve means between the lubricant opening and the chamber permits a flow of pressurized lubricant from the opening to the chamber at a first rotational position of the crankshaft and seals the chamber from the opening at the other rotational positions of the crankshaft. The inlet rotary valve means comprises an opening of the conduit adjacent the crank pin and means for aligning the opening of the conduit and the lubricant opening at said first rotational position. An outlet valve is connected to the chamber so as to intermittently permit a flow of lubricant outward from the chamber and limit the lubricant pressure thereon.

The invention offers the possibility of a considerably simplified expandable piston motor when compared with the prior art. Such components as wrist pins, connecting rods and crank pins, all normally found in an engine, are utilized as rotary valves or oscillo-rotary valves to eliminate the many moving parts found in one or more valves of earlier expandable piston motors. Furthermore, the invention allows the charging of lubricant into the chamber and discharging of lubricant from the chamber to be timed precisely with respect to the position of the piston and rotation of the crankshaft. These functions can be timed as desired instead of being dictated by the position of the piston as in the prior art.

DESCRIPTION OF THE PREFERRED EMBODIMENTS

Figure 1:
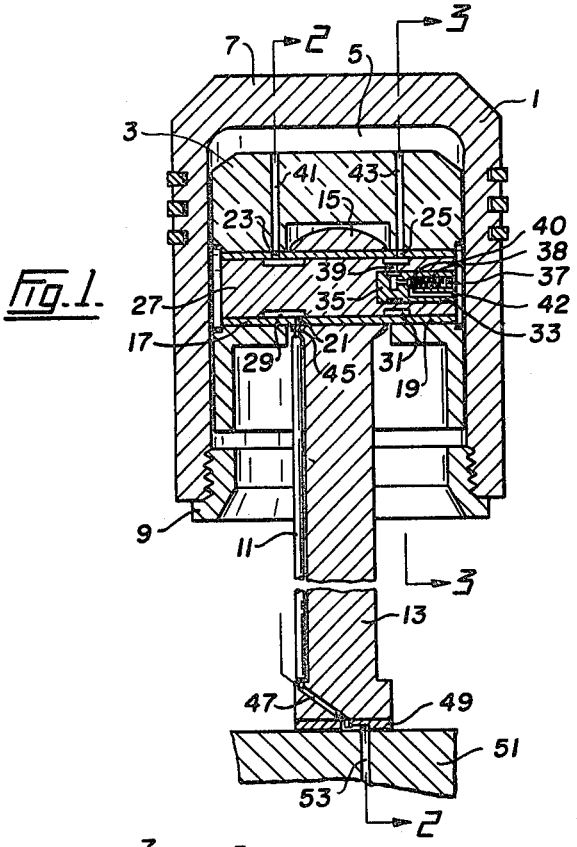
FIG. 1 is a vertical section of the piston, wrist pin, connecting rod and a portion of the crank pin of an engine according to an embodiment of the invention.

As with earlier expanding pistons or variable compression ratio motors, the embodiment of FIGS. 1 to 4 has a piston comprising a first or outer portion 1 and a second or inner portion 3 which is coaxial with the outer portion. Inner portion 3 is slidably received within the outer portion for relative axial movement in the direction of reciprocation of the piston. There is a chamber 5 therebetween adjacent the crown 7 of the piston. The volume of chamber 5 varies with movement of the inner portion between the crown and the retaining ring 9 near the bottom of outer portion 1.

The volume of chamber 5 is increased by filling it with lubricant taken from the pressurized lubrication system of the engine through the conduit 11 on the connecting rod 13. When the engine is operating at part throttle, the volume of fuel and air taken into the combustion chamber is less than at full throttle. Consequently, with a fixed compression ratio motor, the pressure achieved at the time of ignition is less than at full throttle. The efficiency of an engine can be increased if the pressure at part throttle is equal to the pressure at full throttle. An expanding piston motor of the type described achieves this by raising the outer portion 1 of the piston relative to the inner portion 3 and bringing it closer to the top of the combustion chamber. When the engine operates at full throttle, or the pressure in the combustion chamber approaches the design maximum, the lubricant must be discharged from chamber 5.

The connecting rod 13 has its small end 15 non-rotatably mounted on the hollow wrist pin 17. The wrist pin connects the connecting rod to the inner portion 3 of the piston and is rotatably received within the cylindrical recess 19 extending on both sides of the connecting rod. A pair of apertures 21 and 23 comprise an inlet passageway of the wrist pin. Aperture 25 comprises an outlet passageway of the wrist pin. There is a cylindrical insert 27 tightly received within the wrist pin and having a pair of annular grooves 29 and 31 extending about the circumference thereof. Aperture 21 communicates with aperture 23 through the annular groove 29.

There is a cylindrical bore 33 extending axially inwards from one end of insert 27. A ball-type check valve 35 is tightly received within bore 33 and includes an allen screw 37 for adjusting the pressure of spring 38 against ball 40 to vary the pressure at which the check valve opens. When the pressure of lubricant from chamber 5 is sufficient, ball 40 is pushed against spring 38 and the lubricant is discharged through passageway 42. A passageway 39 in insert 27 connects bore 33 to the annular groove 31 and outlet passageway 25 of the wrist pin.

The inner axial portion 3 of the piston has an inlet passageway 41 with a top end forming an opening communicating with chamber 5 and with a bottom end forming an opening adjacent wrist pin 17 and communicating with the cylindrical recess 19. Passageway 41 is aligned axially with aperture 23 of wrist pin 17. Portion 3 of the piston also includes an outlet passageway 43 with a top opening communicating with chamber 5 and a bottom opening extending to wrist pin 17 and recess 19. Passageway 43 is axially aligned with aperture 25 of wrist pin 17.

Figure 2:
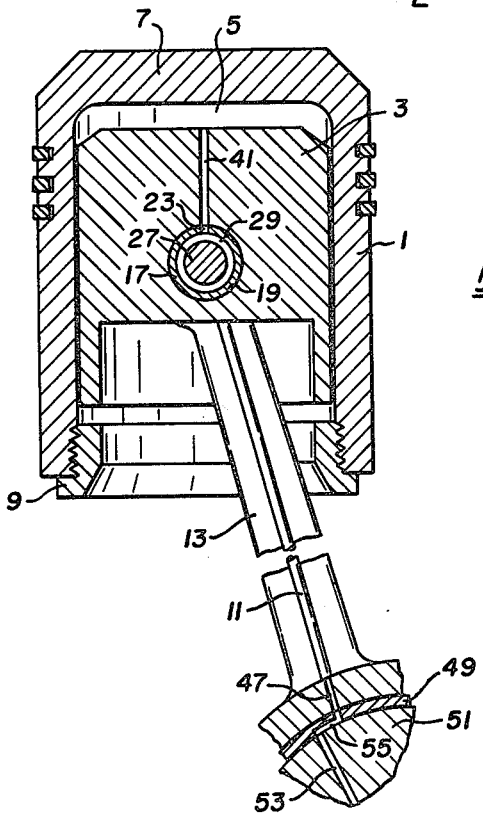
FIG. 2 is a vertical section taken along line 2—2 of FIG. 1 at 60° before top dead center.

FIG. 2 illustrates the position of the connecting rod 13 and wrist pin 17 at a position 60° before top dead center of the piston. As mentioned above, wrist pin 17 is rotatably received within the cylindrical recess 19 and, at this position, aperture 23 of the wrist pin is aligned with the inlet passageway 41 of piston portion 3. Conduit 11 comprises a small tube mounted on connecting rod 13 as well as the passageway 45 extending between the tubing and aperture 21 of the wrist pin 17 as seen in FIG. 1. Because the connecting rod is non-rotatably mounted on the wrist pin, conduit 11 always communicates with aperture 21 and with aperture 23 through the annular groove 29. Only at the 60° before top dead center position as shown in FIG. 2, however, can lubricant from conduit 11 pass between aperture 23 of the wrist pin and inlet passageway 41. The wrist pin 17 and the piston portion 3, including aperture 23 of the wrist pin and inlet passageway 41, act as an inlet oscillo-rotary valve permitting a flow of lubricant from conduit 11 to chamber 5 only at the position shown. Of course, if the flow of lubricant is desired at another rotational position of the crankshaft, the position of aperture 23 on the wrist pin 17 is accordingly altered.

Figure 3:
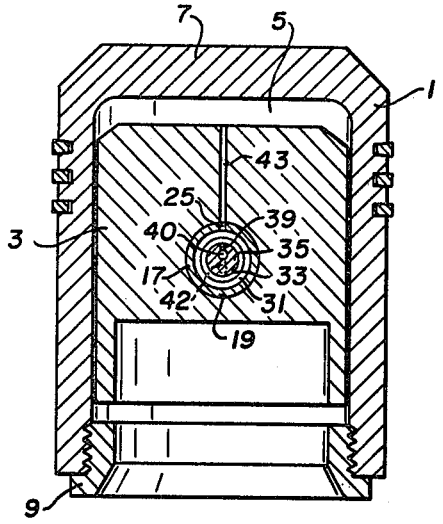
FIG. 3 is a vertical section taken along line 3—3 of FIG. 1 at 20° before top dead center.
Figure 4:
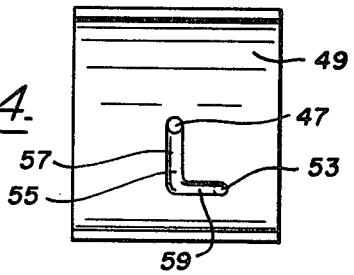
FIG. 4 is a plan view of a portion of the big end bearing of the connecting rod of FIGS. 1 to 3, showing the opening of the oil conduit and the L-shaped groove therein.

In a similar manner, as shown in FIG. 3, piston portion 3, wrist pin 17, as well as passageway 43 and aperture 25, act as an outlet oscillo-rotary valve permitting a flow of lubricant from chamber 5 to check valve 35 only at the position 20° before top dead center as shown. Again, this flow of lubricant can be adjusted to another rotational position of the crankshaft by changing the position of aperture 25 on the wrist pin.

At its lower end, conduit 11 comprises a passageway 47 extending through connecting rod 13 and its big end bearing 49. Big end bearing 49 is rotatably mounted on the crank pin 51 of the engine's crankshaft. In the common manner, there is a lubricant opening 53 on the crank pin 51 for supplying pressurized lubricant to the big end bearing 49. As seen best in FIG. 4, there is an L-shaped groove 55 in the big end bearing 49 extending between the opening of passageway 47 and the position of lubricant opening 53. A portion 57 of the groove extends from passageway 47 in the direction of rotation of crank pin 51 and a portion 59 extends perpendicularly therefrom to the position of lubricant opening 53. As best seen in FIG. 2, lubricant opening 53 communicates with passageway 47 of conduit 11 through groove 55 only at the position 60° before top dead center. Again, this position could easily be varied by changing the dimensions of groove 55 or the position of the lubricant opening 53. Crank pin 51 and lubricant opening 53 therein, together with connecting rod 13, passageway 47 and groove 55 comprise a second inlet rotary valve permitting a flow of lubricant through conduit 11 only at the specified rotational position of the crankshaft.

Figure 5:
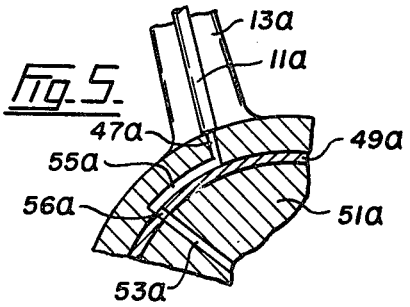
FIG. 5 is an elevational view, partly in section, of an alternative rotary valve means at the crank pin.

An alternative arrangement is shown in FIG. 5 where the groove **55*a* is made in the forging of connecting rod 13*a* itself. An aperture 56*a* in the bearing 49*a* aligns with lubricant opening 53*a* of crank pin 51*a* at the correct rotational position, permitting a flow of lubricant to passageway 47*a* and conduit 11*a***.

Components of the engine are conventional except for those shown and the operation of the engine is substantially the same as usual. However, each time the piston and crankshaft reach the position 60° before top dead center as shown in FIG. 2, aperture 23 of wrist pin 17 is aligned with inlet passageway 41 of piston portion 3 and lubricant opening 53 of crank pin 51 is aligned with passageway 47 of conduit 11 through groove 55 on bearing 49. The pressurized lubricant from opening 53 therefore flows upwardly through conduit 11 to chamber 5 and pushes the outer coaxial portion 1 of the piston upwardly relative to the inner coaxial portion 3. In the case of a four cycle engine, a flow of lubricant to chamber 5 is permitted twice before each compression stroke. When chamber 5 is expanded to its largest volume with lubricant, the outer portion 1 of the piston is raised to its maximum position relative to the inner portion 3. This raises the pressure of gases in the combustion chamber before ignition to a more optimal level when the volume of gases is less than at full throttle.

The position 60° before top dead center for supplying the lubricant to chamber 5 is preferred for these reasons. Firstly, near that point, the speed of the piston decelerates so the outer portion 1 tends to lift and pull the oil into chamber 5 by suction. Additionally, while most of the oil will enter the chamber on the exhaust stroke of a four cycle engine, the compression at 60° before top dead center is not enough to overcome the pressure of the lubrication system of the engine and drive the lubrication back towards the crankshaft.

As with prior art expandable piston motors, there must be a mechanism for limiting the maximum pressure of gases in the combustion chamber according to the characteristics of the particular engine. When the throttle is moved towards the fully open position, the volume of air and fuel entering the cylinder increases. As the piston moves from the 60° before top dead center position of FIG. 2 to the 20° before top dead center position of FIG. 3, the gases in the cylinder are compressed. At the position of FIG. 3, outlet passageway 43 is aligned with aperture 25 of the wrist pin 17. However, lubricant can flow from chamber 5 through passageway 43, aperture 25, annular groove 31, passageway 39 and through check valve 35 only if the pressure of lubricant within chamber 5 caused by compression of the gases is sufficient to open the check valve. When this occurs, the lubricant can flow through check valve 35 and down towards the crankcase between the inner portion 3 and outer portion 1 of the piston. If desired, special passageways could be provided between the piston portions for this purpose.

The position of approximately 20° before top dead center for the release of lubricant from chamber 5 is chosen because this occurs before the point of furthest advance of the ignition for most engines. As mentioned, this position could be varied if desired, but should be timed before ignition to limit the effective compression on ignition.

Allen screw 37 is used to adjust the spring pressure on the ball 41 of check valve 35 and govern the pressure at which oil is released from chamber 5. The oil passageways must be sufficiently large so all of the oil from chamber 5 can be released suddenly at the 20° before top dead center position.

The only additional moving parts found in an engine according to the present invention when compared with a standard internal combustion engine would be the two portions of the piston and the check valve 35. This valve may be substantially identical to those currently used for oil control in cars and which last for the life of the engine. The invention also provides precise timing for admitting lubricant to chamber 5 and discharging lubricant from the chamber unlike prior art devices.

As used herein, the term "rotary valve means" includes both rotary valves and oscillo-rotary valves.

What is claimed is:

1. An internal combustion engine comprising:

a piston, having first and second coaxial parts movable axially relative to each other in the direction of reciprocation of the piston and having a chamber therebetween which varies in volume with said relative movement;

a conduit for fluid connecting said chamber to a lubricant opening on a crank pin of a crankshaft; and inlet rotary valve means between said lubricant opening and said chamber for permitting a flow of pressurized lubricant from the opening to the chamber at a first rotational position of the crankshaft and sealing the chamber from the opening at other rotational positions of the crankshaft; and an outlet passageway connected to the chamber and outlet rotary valve means therein for permitting a flow of lubricant outwardly from the chamber at a second rotational position of the crankshaft.

2. An engine as claimed in claim 1, the second rotational position being generally 20° before top dead center of the piston.

3. An internal combustion engine comprising:

a piston having first and second coaxial parts movable axially relative to each other in the direction of reciprocation of the piston and having a chamber therebetween which varies in volume with said relative movement;

a conduit for fluid connecting said chamber to a lubricant opening on a crank pin of a crankshaft;

inlet rotary valve means between said lubricant opening and said chamber for permitting a flow of pressurized lubricant from the opening to the chamber at a first rotational position of the crankshaft and sealing the chamber from the opening at other rotational positions of the crankshaft; and a wrist pin nonrotatably mounted on the connecting rod and rotatably connected to the second coaxial part of the piston, an outlet passageway in the second part communicating with the chamber and having an opening adjacent the wrist pin and an outlet passageway in the wrist pin having an opening adjacent the second part, the openings of the outlet passageways being aligned at a second rotational position of the crankshaft.

4. An engine as claimed in claim 3 comprising a check valve in the outlet passageways permitting a flow of lubricant from the chamber when the lubricant is above a preset pressure only.

5. An internal combustion engine comprising:

a piston having first and second coaxial parts movable axially relative to each other in the direction of reciprocation of the piston and having a chamber therebetween which varies in volume with said relative movement;

a connecting rod connecting the second coaxial part to a crank pin of a crankshaft;

a conduit for fluid connecting said chamber to a lubricant opening on the crank pin, a portion of said conduit being disposed on said connecting rod;

inlet rotary valve means connected between said lubricant opening and said chamber for permitting a flow of pressurized lubricant from the opening to the chamber at a first rotational position of the crankshaft and sealing the chamber from the opening at other rotational positions of the crankshaft, said inlet rotary valve means comprising an opening of the conduit adjacent the crank pin and means for aligning the opening of the conduit and the lubricant opening at said first rotational position;

and an outlet valve connected to the chamber so as to intermittently permit a flow of lubricant outward from the chamber and limit the lubricant pressure therein.

6. An engine as claimed in claim 5 comprising a big end bearing on the connecting rod rotatably received on the crank pin, the means for aligning comprising a groove on the big end bearing.

7. An internal combustion engine comprising:

a piston having first and second coaxial parts movable axially relative to each other in the direction of reciprocation of the piston and having a chamber therebetween which varies in volume with said relative movement, the second part having a recess for rotatably receiving a wrist pin, an inlet fluid passageway connecting the chamber to the recess and an outlet fluid passageway connecting the chamber to the recess;

a wrist piston rotatably received in the recess, the wrist pin having inlet and outlet fluid passageways therethrough;

an inlet oscillo-rotary valve comprising an opening of the inlet passageway of the second part adjacent the wrist pin and an opening of the inlet passageway of the wrist pin adjacent the second part which are aligned at a first rotational position of a crankshaft;

an outlet oscillo-rotary valve comprising an opening of the outlet passageway of the second part adjacent the wrist pin and an opening of the outlet passageway of the wrist pin adjacent the second part which are aligned at a second rotational position of the crankshaft;

a check valve within said outlet passageways for permitting a flow of fluid from the chamber when said fluid is above a set pressure;

a connecting rod non-rotatably mounted on the wrist pin and having a big end rotatably mounted on a crank pin of a crankshaft, the connecting rod having a conduit communicating at a first end with the inlet passageway of the wrist pin and having an opening at a second end adjacent the crank pin;

an opening for pressurized lubricant on the crank pin; and an inlet rotary valve comprising the opening on the crank pin and the opening at the second end of the connecting rod conduit which are aligned at the first rotational position of the crankshaft.

8. An engine as claimed in claim 7 comprising a big end bearing received on the big end of the connecting rod, an aperture in the big end bearing aligned with the opening on the crank pin at the first rotational position and a groove on the big end of the connecting rod adjacent the big end bearing connecting the aperture in the bearing with the connecting rod conduit.

9. An engine as claimed in claim 7 comprising a groove between the connecting rod and the crank pin communicating with the opening at the second end of the connecting rod conduit and the opening on the crank pin at the first rotational position.

10. An engine as claimed in claim 9, the connecting rod having a big end bearing, the groove being on the big end bearing adjacent the crank pin and being L-shaped, having a first portion extending from the opening on the connecting rod parallel with the direction of rotation and having a second portion extending perpendicularly therefrom, the opening on the crank pin being aligned with the second portion at the first rotational position.

11. An engine as claimed in claim 9, the first rotational position being generally 60° before top dead center.

12. An engine as claimed in claim 9, the second rotational position being generally 20° before top dead center.

13. An engine as claimed in claim 9, comprising a generally cylindrical insert within the wrist pin, the check valve being within the insert.

* * * * *